US007479955B2

(12) United States Patent
Yoshida

(10) Patent No.: US 7,479,955 B2
(45) Date of Patent: Jan. 20, 2009

(54) DRIVE DEVICE OF LIGHT EMITTING DISPLAY PANEL

(75) Inventor: Takayoshi Yoshida, Yonezawa (JP)

(73) Assignee: Tohoku Pioneer Corporation, Tendo-shi (JP)

( * ) Notice: Subject to any disclaimer, the term of this patent is extended or adjusted under 35 U.S.C. 154(b) by 747 days.

(21) Appl. No.: 11/212,561

(22) Filed: Aug. 29, 2005

(65) Prior Publication Data

US 2006/0055631 A1 Mar. 16, 2006

(30) Foreign Application Priority Data

Aug. 31, 2004 (JP) ..... 2004-251536

(51) Int. Cl.
*G09G 5/00* (2006.01)

(52) U.S. Cl. ..... 345/211; 345/76

(58) Field of Classification Search ..... 345/76–83, 345/204, 211–213; 250/553
See application file for complete search history.

(56) References Cited

U.S. PATENT DOCUMENTS 5,594,463 A * 1/1997 Sakamoto ..... 345/76
6,501,230 B1 * 12/2002 Feldman ..... 315/169.3
6,528,951 B2 * 3/2003 Yamazaki et al. ..... 315/169.3
6,661,180 B2 * 12/2003 Koyama ..... 315/169.3
7,245,297 B2 * 7/2007 Kimura et al. ..... 345/214
7,362,322 B2 * 4/2008 Kimura et al. ..... 345/211
2005/0017933 A1 * 1/2005 Koyama ..... 345/76

FOREIGN PATENT DOCUMENTS

JP 2003-162255 6/2003

* cited by examiner

*Primary Examiner*—Richard Hjerpe
*Assistant Examiner*—Tom V Sheng
(74) *Attorney, Agent, or Firm*—Westerman, Hattori, Daniels & Adrian, LLP

(57) ABSTRACT

In a light emitting display panel 10, a large number of light emitting display pixels 10*a* are arranged in a matrix pattern, and a monitoring element Ex is provided therein which can extract a voltage which corresponds to the forward voltage of EL elements E1 on the display panel. By a signal from a current consumption detection section 14 which detects current consumption in the light emitting display panel 10, a drive ratio control section 15 performs ON/OFF control of a transistor Tr3 which is connected in series to the monitoring element Ex to control current provided from a constant current circuit. Thus, progression rates of agings of the monitoring element Ex and the EL elements E1 arranged in the display panel can be controlled to roughly coincide with each other, and a power loss generated in a light emission drive transistor Tr2 in each pixel 10*a* can be restrained as much as possible.

10 Claims, 6 Drawing Sheets

DRIVE DEVICE OF LIGHT EMITTING DISPLAY PANEL

BACKGROUND OF THE INVENTION

1. Field of the Invention

The present invention relates to a drive device of a light emitting display panel in which a large number of self light emitting elements are arranged in a matrix pattern as display pixels, and more particularly to a drive device of a light emitting display panel in which the display pixels can be driven to be lit efficiently by improvement in the utilization efficiency of electrical power in a power supply section.

2. Description of the Related Art

Demand for a display panel which has a high definition image display function and which can realize a thin shape and low power consumption has increased due to popularity of cellular telephones, personal digital assistants (PDAS), and the like, and conventionally a liquid crystal display panel has been adopted in many products as the one which meets the needs thereof. Meanwhile, these days a display panel utilizing an organic EL element whose characteristic as being a self light emitting type display element is best used has been manufactured, and this have attracted attention as a next generation display panel in place of the conventional liquid crystal display panel. A background thereof is that by employing, in a light emitting layer of the element, an organic compound which enables an excellent light emission characteristic to be expected, a high efficiency and a long life which can be equal to practical use have been advanced.

The organic EL element is constructed by laminating a transparent electrode for example by ITO, a light emission functional layer formed of an organic material, and a metallic electrode one by one basically on a transparent substrate such as glass or the like. The light emission functional layer may be a single layer of an organic light emitting layer, or a double layer structure composed of an organic positive hole transport layer and an organic light emitting layer, or a triple layer structure composed of an organic positive hole transport layer, an organic light emitting layer, and an organic electron transport layer, or a multilayer structure in which an injection layer of electron or positive hole is inserted into an appropriate portion among these layers.

The organic EL element can be represented electrically by an equivalent circuit as shown in FIG. 1. That is, the organic EL element can be replaced by a structure composed of a diode component E as a light emitting component and a parasitic capacitance component Cp which is connected in parallel to this light emitting component E, and thus the organic EL element has been considered as a capacitive light emitting element. When a light emission drive voltage is applied to this organic EL element, at first, electrical charges corresponding to the electric capacity of this element flow into the electrode as a displacement current and are accumulated. It can be considered that when the drive voltage then exceeds a determined voltage (light emission threshold voltage=Vth) peculiar to this element, current begins to flow from an electrode (anode side of the diode component E) to an organic layer constituting the light emitting layer so that the element emits light at an intensity proportional to this current.

FIG. 2 shows light emission static characteristics of such an organic EL element. According to these, the organic EL element emits light at an intensity L approximately proportional to a drive current I as shown in FIG. 2(*a*) and emits light while the current I flows drastically when the drive voltage V is the light emission threshold voltage Vth or higher as shown by a solid line in FIG. 2(*b*).

In other words, when the drive voltage is the light emission threshold voltage Vth or lower, current rarely flows in the EL element, and the EL element does not emit light. Therefore, the EL element has an intensity characteristic that in a light emittable region in which the drive voltage is higher than the threshold voltage Vth, the greater the value of the voltage V applied to the EL element, the higher the light emission intensity L thereof as shown by the solid line in FIG. 2(*c*).

Meanwhile, it has been known that physical properties of the organic EL element change due to long-term use to cause forward voltage Vf to become greater. Thus, as shown in FIG. 2(*b*), the V-I characteristic of the organic EL element changes in a direction shown by the arrow (characteristic shown by the broken line) due to actual use time, and therefore the intensity characteristic is also deteriorated. The organic EL element also has a problem that variations in initial intensities occur due to for example variations in deposition at the time of film formation of this element, and thus it becomes difficult to express intensity gradation faithful to an input video signal.

Further, it has also been known that the intensity property of an organic EL element changes due to changes in the temperature roughly as shown by broken lines in FIG. 2(*c*). That is, while the EL element has the characteristic that the greater the value of the voltage V applied thereto, the higher the light emission intensity L thereof in the light emittable region in which the drive voltage is higher than the light emission threshold voltage, the EL element also has a characteristic that the higher the temperature becomes, the lower the light emission threshold voltage becomes. Accordingly, the intensity of the EL element has a temperature dependency that the higher the temperature becomes, the lower the applied voltage by which light emission becomes possible and that the EL element is brighter at a high temperature time and is darker at a lower temperature time though the same light emittable voltage is applied.

Meanwhile, regarding the organic EL element, due to reasons that the voltage-intensity characteristic thereof is unstable with respect to temperature changes while the current-intensity characteristic thereof is stable with respect to temperature changes and that degradation of the element due to an excess current should be prevented, a constant current drive is performed in general. In this case, a drive voltage (referred to also as an output voltage) Vo which is supplied from a power supply section for example constituted by a DC/DC converter or the like to a constant current circuit has to be set, considering the following respective factors.

That is, as the factors, it is possible to enumerate the forward voltage Vf of the EL element, a variation VB of the Vf of the EL element, an aging fraction VL of the Vf, a temperature change fraction VT of the Vf, a drop voltage VD necessary for allowing the constant current circuit to perform a constant current operation, and the like. Even when these factors interact synergistically, in order to fully ensure the constant current characteristic of the constant current circuit, the drive voltage Vo has to be set at a value obtained by adding maximum values of respective voltages shown as the respective factors.

However, a case hardly occurs where the voltage value obtained by adding the maximum values of the respective voltages as described above is needed as the drive voltage Vo supplied to the constant current circuit, and in a usual state, a large power loss as a voltage drop in the constant current circuit is brought about. Therefore, this becomes a primary factor of generation of heat, thereby putting stress on organic EL elements, peripheral circuit parts, and the like.

Japanese Patent Application Laid-Open No. 2003-162255 discloses that a monitoring EL element which measures the forward voltage Vf of an EL element which is arranged in a display panel to perform light emitting display is provided other than the EL element performing light emitting display so as to control the drive voltage provided from the power supply section while utilizing the forward voltage Vf obtained from the monitoring EL element. By the structure disclosed in Japanese Patent Application Laid-Open No. 2003-162255, the drive voltage provided from the power supply section is controlled in response to aging of the EL element and changes of environmental temperature, and thus improvement in the utilization efficiency of the power supply can be expected.

In a display panel employing a self light emitting element represented by the organic EL element, a lighting ratio or an intensity (drive current) of a self light emitting element arranged in a display panel is determined by a display content (image signal), and by this a progression rate of aging of the self light emitting element is roughly determined. That is, in a case where a bright (intensity is high) image is reproduced averagely, the progression rate of an average aging of elements is advanced, and in a case where a dark (intensity is low) image is reproduced averagely, the progression rate of an average aging of the elements is retarded.

However, according to the structure disclosed in Japanese Patent Application Laid-Open No. 2003-162255, control is performed such that, in a sense, a constant current is constantly applied to the monitoring element which measures the forward voltage Vf, so that the drive voltage provided from the power supply section is controlled based on the forward voltage. Therefore, the monitoring element and the self light emitting element constituting a display panel reach a state in which their progression rates of agings become gradually different with the elapse of use time. Accordingly, even when the drive voltage provided from the power supply section is controlled while the forward voltage obtained from the monitoring element is utilized as in the structure disclosed in Japanese Patent Application Laid-Open No. 2003-162255, it becomes impossible to maintain the utilization efficiency of electrical power in the power supply section at an optimum state.

That is, since the forward voltage obtained from the monitoring element and the average forward voltage of self light emitting elements constituting a display panel have different progression rates of agings, they gradually dissociate, and it becomes impossible to constantly supply an optimum drive voltage from the power supply section in response to the advance of aging of the self light emitting elements constituting the display panel. In other words, while it is anticipated that the dissociation between the forward voltage obtained by the monitoring element and the average forward voltage of self light emitting elements constituting a display panel occurs, a higher power supply voltage has to be set initially in the power supply section. Thus, there is a problem that useless power consumption is generated in an initial stage or a standard state.

SUMMARY OF THE INVENTION

The present invention has been developed based on the above-described technical viewpoint, and it is an object of the present invention to provide a drive device of a light emitting display panel in which an appropriate drive voltage can be constantly supplied from the power supply section to a display panel side to further improve the utilization efficiency of electrical power by comprising a control mode by which the progression rate of aging of the monitoring element roughly coincides with the progression rate of aging of self light emitting elements constituting a display panel.

A drive device of a light emitting display panel according to the present invention which has been developed in order to solve the problem is a drive device of a light emitting display panel in which a large number of self light emitting elements are arranged as display pixels in a matrix pattern, characterized by comprising a monitoring element which can extract a voltage value which corresponds to the forward voltage of the self light emitting elements arranged in the light emitting display panel, a power supply section in which a drive voltage which is given to the light emitting display panel is controlled based on the voltage value which corresponds to the forward voltage obtained from the monitoring element, a current consumption detection section which detects a current consumption value in the display panel which is driven by the power supply voltage provided from the power supply section, and a drive ratio control section which regulates a progression rate of aging in the monitoring element by controlling current which is applied to the monitoring element in response to the current consumption value detected by the current consumption detection section.

DESCRIPTION OF THE PREFERRED EMBODIMENTS

Figure 1:
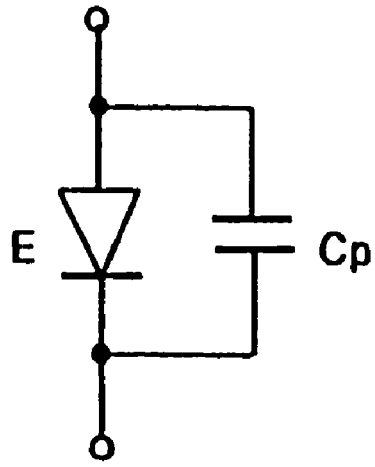
FIG. 1 is a view showing an equivalent circuit of an organic EL element.
Figure 2A:
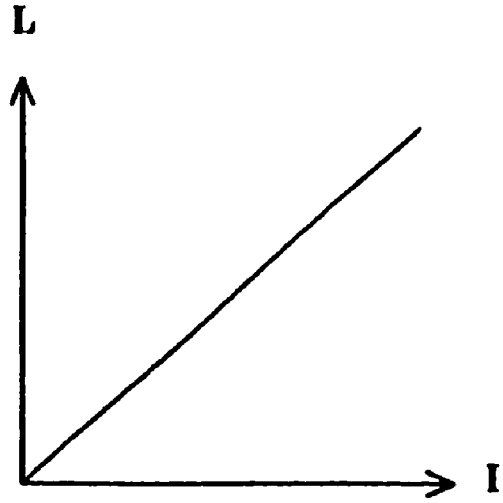
FIG. 2 is views showing the characteristics of the organic EL element.
Figure 2B:
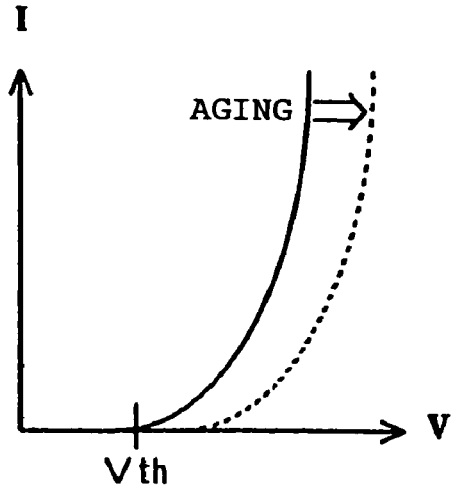
Figure 2C:
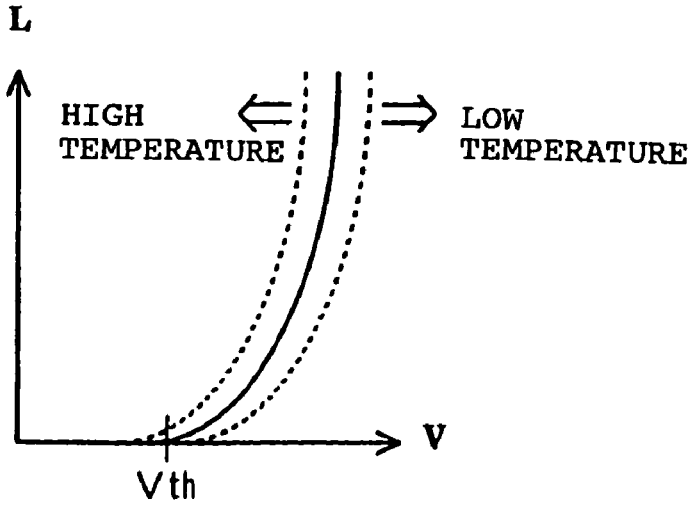
Figure 3:
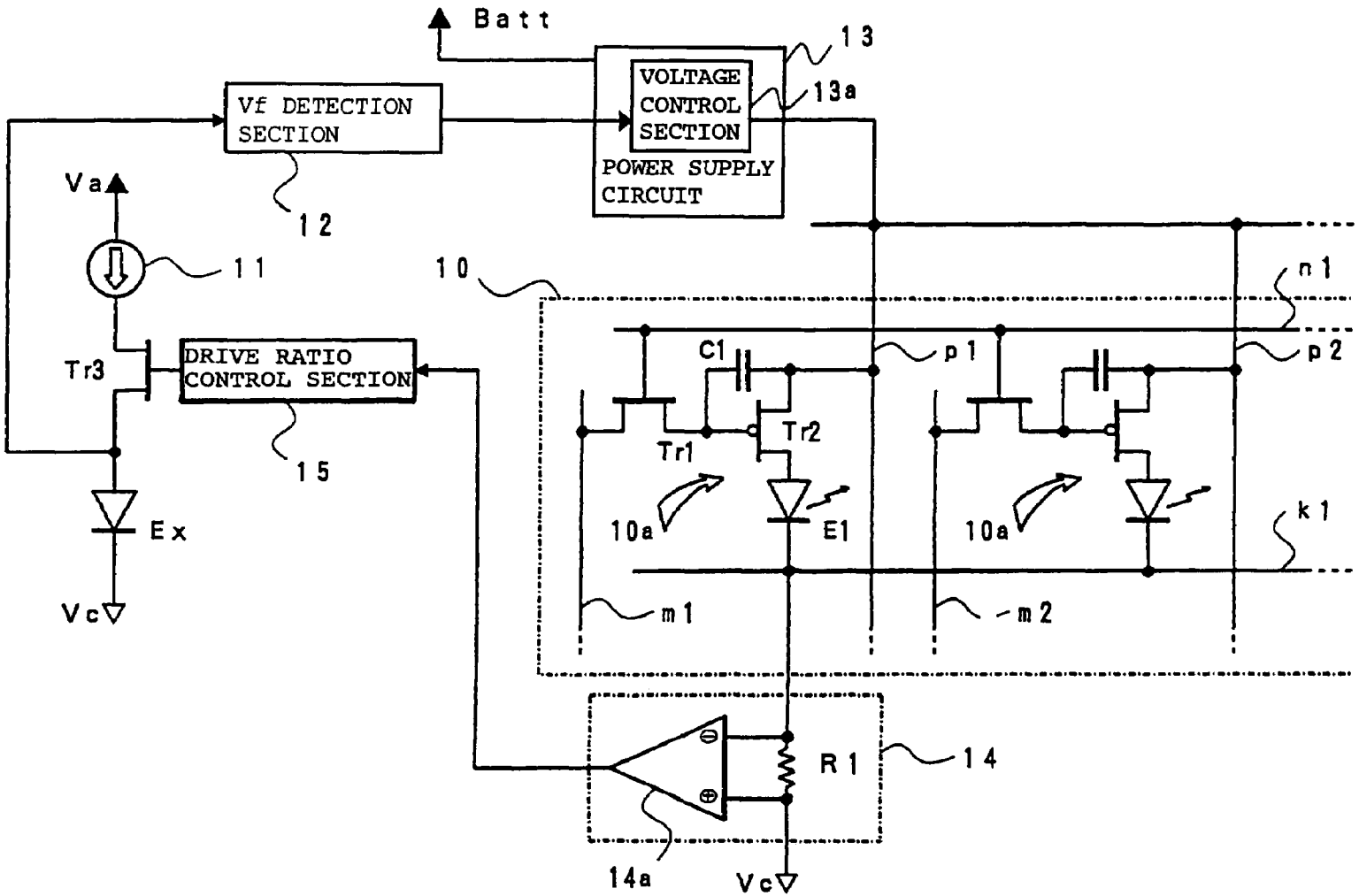
FIG. 3 is a circuit structure diagram showing a first embodiment in a drive device of a light emitting display panel according to the present invention.

A drive device of a light emitting display panel according to the present invention will be described below based on embodiments shown in the drawings. FIG. 3 shows a first embodiment thereof and shows the structure of a part of a display panel in which active matrix type display pixels are provided and a block structure of a drive circuit which drives the display panel for lighting it.

In FIG. 3, in a light emitting display panel designated by reference numeral 10, display pixels 10*a* are arranged in a matrix pattern. FIG. 3 shows a condition in which only two pixels 10*a* are arranged in a row direction for convenience of illustration.

In the light emitting display panel 10, data lines m1, m2, . . . to which a data signal provided from an unillustrated data driver is supplied are arranged in a vertical direction (column direction), and scan selection lines n1, . . . to which a scan selection signal provided from an unillustrated scan driver is supplied are arranged in a horizontal direction (row direction). Further, in the display panel 10, power supply lines p1, p2, . . . are arranged corresponding to the respective data lines in the vertical direction.

For the display pixel 10*a*, a pixel structure by a conductance control drive method is shown as one example. That is, as reference characters are designated to respective elements constituting the pixel 10*a* of a left side in the display panel 10 shown in FIG. 3, the gate of a control transistor Tr1 constituted by an N-channel type TFT (thin film transistor) is connected to the scan selection line n1, and the source thereof is connected to the data line m1. The drain of the control transistor Tr1 is connected to the gate of a light emission drive transistor Tr2 constituted by a P-channel type TFT and to one terminal of a charge-retaining capacitor C1.

The source of the light emission drive transistor Tr2 is connected to the other terminal of the capacitor C1 and to the power supply line p1. The anode of an organic EL element E1 as a self light emitting element is connected to the drain of the light emission drive transistor, and the cathode of this EL element E1 is connected to a common cathode line K1 and to a cathode side power supply line Vc via a current consumption detection section 14 later described. Thus, a large number of display pixels 10*a* of the same structure as the above-described structure are arranged in a matrix pattern in vertical and horizontal directions in the display panel 10 as described above.

In the above-described pixel structure, when an ON voltage is supplied from the unillustrated scan driver to the gate of the control transistor Tr1 via the scan selection lines n1, the control transistor Tr1 allows current corresponding to a data voltage which is supplied from the data line m1 to the source to flow from the source to the drain. Accordingly, during a period in which the gate of the control transistor Tr1 is at the ON voltage, the capacitor C1 is charged, and this voltage is supplied to the gate of the light emission drive transistor Tr2.

Therefore, the light emission drive transistor Tr2 allows current based on the gate voltage and the source voltage thereof to flow in the EL element E1 so that the EL element is driven to emit light. That is, in this embodiment, the light emission drive transistor Tr2 constituted by a TFT operates in a saturation region, and the EL element E1 is driven by a constant current so that the EL element E1 is driven to emit light.

When the gate of the control transistor Tr1 becomes an OFF voltage, this transistor becomes so-called cut-off. Although the drain D of the control transistor Tr1 is in an open state, the gate voltage of the light emission drive transistor Tr2 is retained by electrical charges accumulated in the capacitor C1 so that drive current is maintained until a next scan selection time, and thus light emission of the EL element E1 is also maintained.

In this embodiment, a monitoring element Ex is provided so that a voltage value Vf corresponding to the forward voltage of the EL element E1 as a self light emitting element arranged in the display panel 10 can be obtained. The cathode side of this monitoring element Ex is connected to the cathode side power supply line Vc, and to the anode side thereof, a transistor Tr3 by an N-channel type TFT as an active element is connected in series. Further, to the transistor Tr3, a current source which can supply a predetermined (constant) current to the monitoring element Ex, that is, a constant current circuit 11, is connected. Va is an anode side power supply line which supplies a drive voltage to the constant current circuit 11.

The transistor Tr3 performs a switching operation by a later-described drive ratio control section 14, and with an ON operation of this transistor Tr3, the constant current from the constant current circuit 11 is supplied to the monitoring element Ex.

It is desired that an element which has the same electrical characteristics (same specifications) as those of the organic EL element E1 constituting the display pixel 10*a* is employed as the monitoring element Ex. Preferably, films of the organic EL element E1 constituting the display pixel 10*a* and the monitoring element Ex are simultaneously formed in the display panel 10 by the same manufacturing process. Accordingly, when the drive current flows from the constant current circuit 11 to the monitoring element Ex, since a light emission operation is accompanied thereby, it is desired that the monitoring element Ex is covered with an unillustrated shield mask which blocks the light emitted therefrom.

The forward voltage Vf is obtained from the anode terminal of the monitoring element Ex, and this is supplied to a Vf detection section 12. This Vf detection section 12 is for example constituted by a buffer amplifier, and the output by this Vf detection section 12 can be utilized as one which corresponds to the forward voltages of the light emitting display EL elements E1 arranged in the display panel 10. The output by this Vf detection section 12 is supplied to a power supply circuit 13 provided as the power supply section.

The power supply circuit 13 is constituted by a DC/DC converter or the like which boosts a primary side voltage supplied from an unillustrated battery to obtain a drive voltage of the display panel 10. A voltage control section 13*a* in the power supply circuit 13 controls a boosted voltage level in the DC/DC converter based on the output from the Vf detection section 12 and outputs the drive voltage which is to be given to the display panel 10.

Respective currents of cathode sides of respective EL elements E1 in the display panel 10 which is driven to emit light by the drive voltage provided from the power supply circuit 13 are gathered via common cathode lines K1, . . . as described above and further flow in the cathode side power supply line Vc via the current consumption detection section 14. In this current consumption detection section 14, a dropper resistor R1 lies on a current path, and a differential amplifier 14*a* which extracts the voltage between both ends of this dropper resistor R1 is provided. Therefore, a control voltage which is proportional to the voltage between both ends of this dropper resistor R1 can be obtained from the current consumption detection section 14.

The control voltage obtained from the current consumption detection section 14 is proportional to a mean lighting ratio or a mean drive current value of the respective EL elements E1 in the display panel 10, and thus this becomes an index showing the degree of average deterioration of display EL elements E1 based on aging. In short, it can be the that in a case where the value of the control voltage obtained by the current consumption detection section 14 is large, progression of the degree of the average degradation of the respective display EL elements E1 is fast, and that in a case where the value of the control voltage obtained by the current consumption detection section 14 is small, progression of the degree of the average degradation of the respective display EL elements E1 is slow.

The control voltage obtained by the current consumption detection section 14 is supplied to a drive ratio control section 15 as shown in FIG. 3, and the switching operation of the transistor Tr3 is performed by the drive ratio control section 15 so that a time supply ratio of current supplied from the constant current circuit 11 to the monitoring element Ex is controlled. In this embodiment, as one means thereof, the drive ratio control section 15 operates to change a switching duty cycle of the transistor Tr3.

That is, the drive ratio control section 15 generates a pulse width modulation (PWM) signal based on the control voltage provided from the current consumption detection section 14 to supply this to the gate of the transistor Tr3. Thus, when the level of the control voltage obtained by the current consumption detection section 14 is high, control is performed such that the duty cycle (pulse width) of the PWM signal becomes high, and when the level of the control voltage obtained by the current consumption detection section 14 is low, control is performed such that the duty cycle of the PWM signal becomes low.

By the operations described above, the drive current of the pulse width approximately proportional to the mean lighting ratio or the mean drive current value of the respective EL elements E1 in the display panel 10 is supplied from the constant current circuit 11 to the monitoring element Ex. Thus, the monitoring element Ex is regulated so as to be in a state roughly corresponding to the progression rate of an average aging of the respective EL elements E1 in the display panel 10. Thus, aging of the forward voltage obtained by the monitoring element Ex and aging of the mean forward voltage of the respective EL elements E1 in the display panel 10 can be allowed to approximately correspond to each other.

Therefore, by adopting the structure in which the boosted voltage level for example of the DC/DC converter in the power supply circuit 13 is controlled based on the output from the Vf detection section 12 as described above, the aging fraction VL of the forward voltage Vf in the light emitting display EL elements E1 arranged in the display panel 10 is effectively compensated, and in addition, the drive voltage applied to respective pixels 10*a* is controlled in a state in which temperature change fraction VT or the like of the Vf is also compensated.

Thus, the light emission drive transistors Tr2 of the respective display pixels 10*a* arranged in the display panel 10 can drive the respective EL elements E1 in a state in which the transistors Tr2 secure a drop voltage VD of a degree by which a constant current characteristic can be maintained. Accordingly, a power loss generated in the light emission drive transistor Tr2 in each pixel 10*a* can be restrained as much as possible.

In the embodiment shown in FIG. 3, the current consumption detection section 14 is inserted in series to the cathode sides of the respective display EL elements E1 arranged in the light emitting display panel 10. However, even when this current consumption detection section 14 is inserted in series to the anode sides of the display EL elements E1, that is, between the power supply circuit 13 and the respective power supply lines p1, p2, . . . , similar operations and effects can be obtained.

Although the embodiment shown in FIG. 3 is described in which the light emission drive transistor Tr2 by a TFT constituting each display pixel 10*a* is operated in a saturation region so as to have a constant current characteristic, this light emission drive transistor Tr2 may be operated in a linear region so as to perform a constant voltage operation (switching operation). Even when the light emission drive transistor Tr2 is allowed to perform the constant voltage operation in this manner, an appropriate lighting drive voltage can be given to each pixel 10*a* which is driven by a constant voltage.

Here, in a case where for example a full color image is to be reproduced by employing self light emitting elements of this kind represented by the organic EL element, one pixel is constructed by treating respective sub-pixels provided with elements which emit R (red), G (green), and B (blue) lights that are three primary colors of light, respectively, as a group. In this case, the EL elements constituting respective sub-pixels of R, G, and B have light emission efficiencies which are different from one another and also have lighting times which are different from one another in response to a reproduced image, so that differences among the degrees of aging occur. Further, the respective sub-pixels have different temperature characteristics.

Accordingly, for example, in a drive device of a display panel reproducing a full color image as described above, it is desired to adopt a structure in which a combination of the monitoring element Ex, the transistor Tr3 as an active element, the constant current circuit 11 as a current source, the Vf detection section 12, the power supply circuit 13, the current consumption detection section 14, and the drive ratio control section 15 is respectively provided corresponding to respective sub-pixels of R, G, and B.

Figure 4:
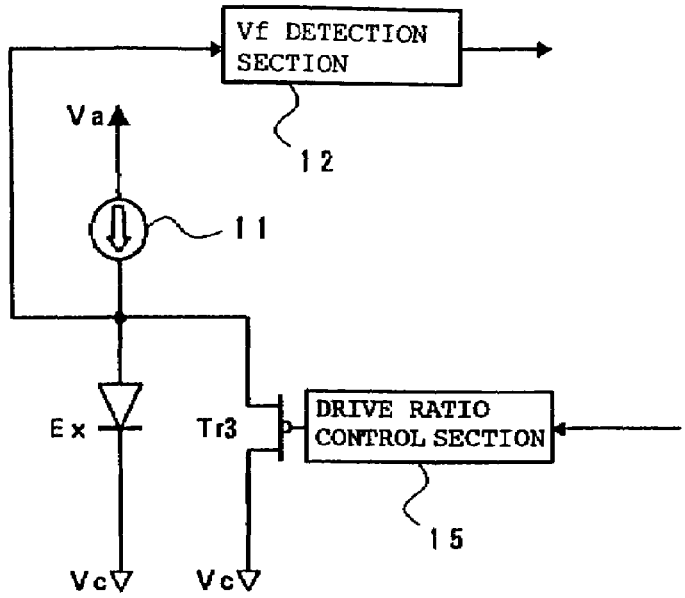
FIG. 4 is a circuit structure diagram showing an example of a structure of a part including a monitoring element which can be adopted in the structure shown in FIG. 3.

FIG. 4 shows another example in which a time supply ratio of the current supplied from the constant current circuit 11 which is provided as a current source to the monitoring element Ex is controlled. That is, in the example shown in FIG. 4, the constant current circuit 11 and the monitoring element Ex are connected in series between the power supply lines Va and the Vc, and a P-channel type transistor Tr3 as an active element is connected between the anode of the monitoring element Ex and the power supply line Vc.

That is, in the structure shown in FIG. 4, when the transistor Tr3 is turned on, current from the constant current circuit 11 bypasses the transistor Tr3, so that current supply to the monitoring element Ex is stopped. Meanwhile, when the transistor Tr3 is turned off, the current from the constant current circuit 11 is supplied to the monitoring element Ex. From the drive ratio control section 15, the pulse width modulation (PWM) signal based on the control voltage provided from the current consumption detection section 14 is supplied as already described with reference to FIG. 3.

In the structure shown in FIG. 4, the transistor Tr3 is constituted by a P-channel type TFT, and thus when the duty cycle (pulse width) of the PWM signal provided from the drive ratio control section 15 becomes higher, a time ratio by which the current from the constant current circuit 11 bypasses the transistor Tr3 becomes lower. In other words, the time supply ratio of the current supplied from the constant current circuit 11 to the monitoring element Ex becomes higher.

Conversely to the above-described operation, when the duty cycle (pulse width) of the PWM signal provided from the drive ratio control section 15 becomes lower, a time ratio by which the current from the constant current circuit 11 bypasses the transistor Tr3 becomes higher, whereby the time supply ratio of the current supplied from the constant current circuit 11 to the monitoring element Ex becomes lower. Accordingly, in the structure shown in FIG. 4 also, operations and effects similar to those of the structure shown in FIG. 3 can be obtained.

Figure 5:
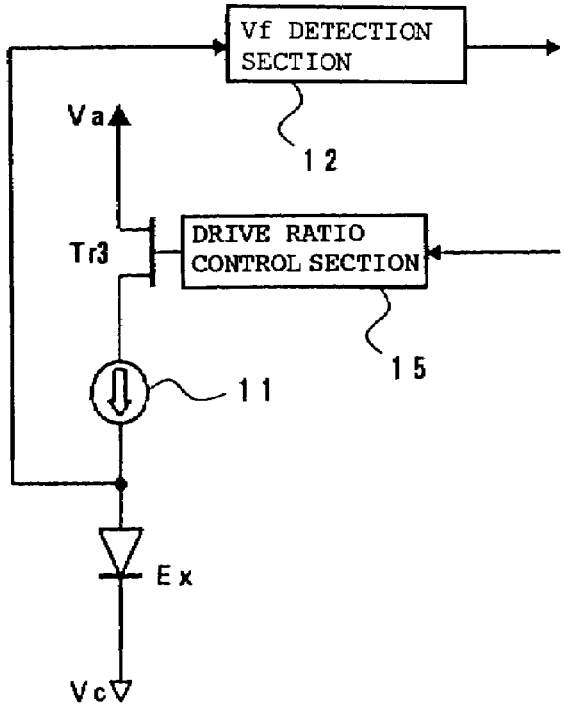
FIG. 5 is a circuit structure diagram showing another example of a structure including the monitoring element similarly.

FIG. 5 further shows another example in which the time supply ratio of the current supplied from the constant current circuit 11 which is provided as a current source to the monitoring element EX is controlled. That is, in the example shown in FIG. 5, the order of the transistor Tr3, the constant current circuit 11, and the monitoring element Ex which are connected in series between the power supply lines Va and Vc is replaced with that of the example shown in FIG. 3. Accordingly, in this structure also, operations and effects similar to those of the structure shown in FIG. 3 can be obtained.

Figure 6:
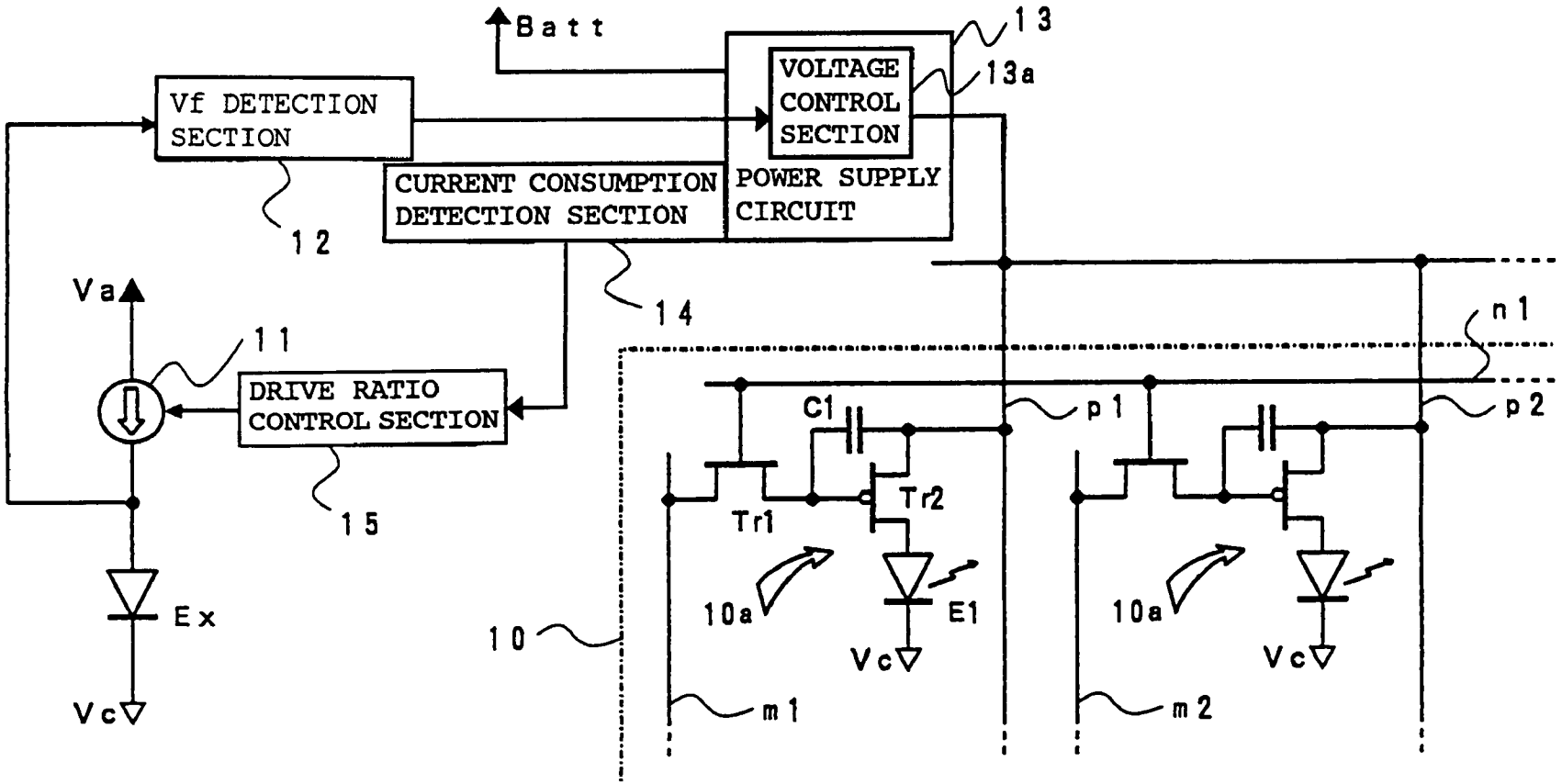
FIG. 6 is a circuit structure diagram showing a second embodiment in a drive device of a light emitting display panel according to the present invention.

FIG. 6 shows a second embodiment of a drive device of a light emitting display panel according to the present invention and shows the structure of a part of the display panel equipped with active matrix type display pixels similarly and a block structure of a drive circuit which drives this part for light emission. In FIG. 6, parts which carry out the same functions as those of the respective parts shown in FIG. 3 already described are designated by the same reference numerals. Accordingly, detailed description thereof will be omitted.

In the embodiment shown in FIG. 6, the cathodes of respective EL elements E1 arranged in a display panel 10 are respectively connected to the cathode side power supply line Vc. Further, in the embodiment shown in FIG. 6, a detection value by the current consumption detection section 14 is obtained in response to a pulse signal added to a switching element in a DC/DC converter constituting a power supply circuit as described later in detail.

The drive ratio control section 15 operates based on the detection value by the current consumption detection section 14 so that the value of the current supplied from constant current circuit 11 which is provided as a current source to the monitoring element Ex is controlled. Thus, the progression rate of aging in the monitoring element Ex is regulated. That is, in the structure shown in this FIG. 6, the drive ratio control section 15 controls the direct current value supplied from the constant current circuit 11 to the monitoring element Ex such that the progression rate of aging of the monitoring element Ex and the progression rate of an average aging of respective EL elements E1 in the display panel 10 roughly coincide with each other.

Figure 7:
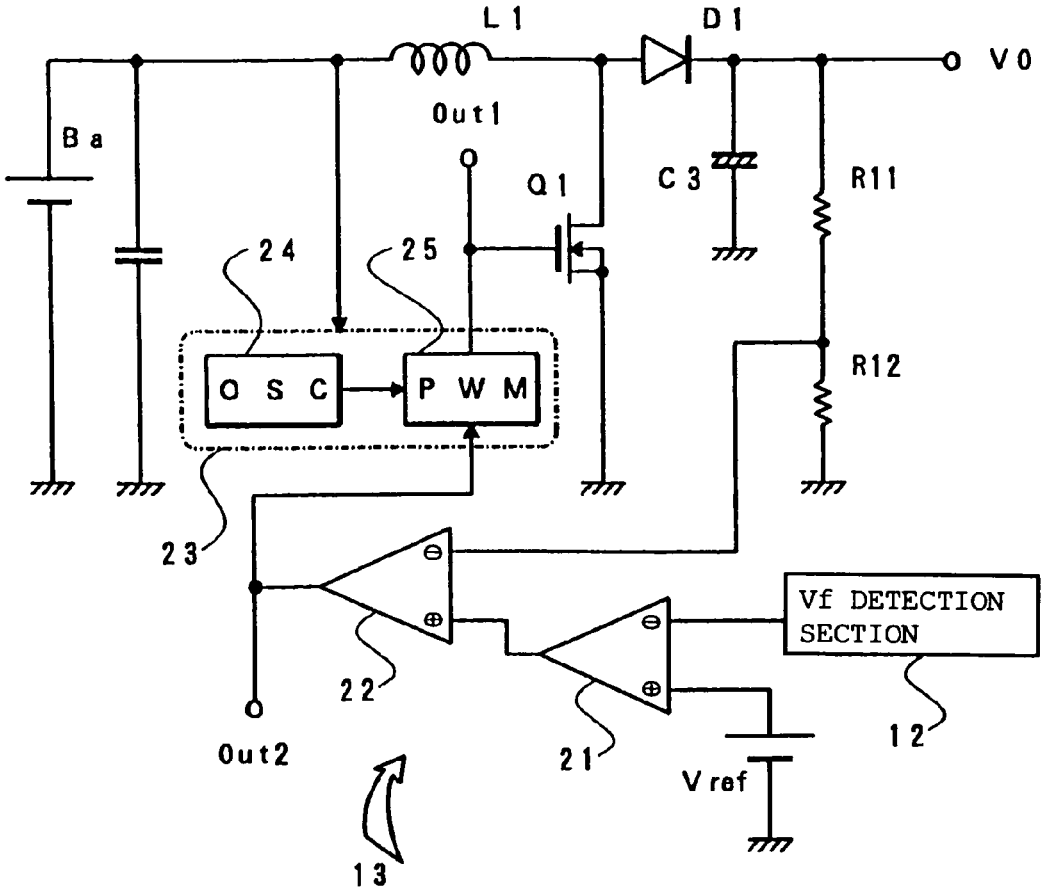
FIG. 7 is a circuit structure diagram showing an example of a DC/DC converter which can be appropriately adopted in the embodiment shown in FIG. 6.

FIG. 7 shows a structure of the above-described power supply circuit 13 and the current consumption detection section 14 shown in FIG. 6, and the structure shown in this FIG. 6 shows an example of a DC/DC converter of a PWM drive method. The output from the Vf detection section 12 is supplied to one input terminal (inverting input terminal) of an error amplifier 21 constituting the power supply circuit 13. To the other input terminal (non-inverting input terminal) of the error amplifier 21, a reference voltage Vref is supplied, and thus the error amplifier 21 generates a comparison output (error output) between the output from the Vf detection section 12 and the reference voltage Vref.

The output by the error amplifier 21 is supplied to one input port (non-inverting input terminal) of an error amplifier 22. To the other input port (inverting input terminal) of the error amplifier 22, a divided output voltage by resistance elements R11 and R12 which divide an output voltage Vo of the power supply circuit 13 is supplied. Accordingly, the output voltage value of the error amplifier 22 contains both output information of the output from the Vf detection section 12 and the output voltage Vo of the power supply circuit 13.

In the structure shown in FIG. 7, a DC/DC converter of a voltage boost type is utilized for the power supply circuit 13, and the output of the error amplifier 22 is supplied to a switching signal generation circuit 23 constituting the DC/DC converter. This switching signal generation circuit 23 is provided with a reference triangular wave oscillator 24 and a PWM circuit 25. The PWM circuit 25 is provided with an unillustrated comparator, and the output from the error amplifier 22 and a triangular wave from the reference triangular wave oscillator 24 are supplied to this comparator so that a PWM signal is generated from the PWM circuit 25.

The pulse signal by the PWM provided from the PWM circuit 25 is supplied to the gate of a power FET Q1 so that the FET Q1 performs a switching operation. That is, by an ON operation of the power FET Q1, electrical energy from a direct current voltage source (battery) Ba is accumulated in an inductor L1, and when an OFF operation of the FET Q1 is performed, the electrical energy accumulated in the inductor is accumulated in a capacitor C3 via a diode D1.

By the repeats of the ON/OFF operation of the FET Q1, a boosted DC output can be obtained as a terminal voltage of the capacitor C3, and this becomes the output voltage Vo provided from the power supply circuit 13. This output voltage Vo is divided by the resistors R11 and R12 as described above to be fedback to the error amplifier 21 so as to maintain a predetermined output voltage Vo.

In the structure shown in FIG. 7, the PWM signal supplied to the gate of the power FET Q1, that is, the output of an terminal Out1, can be utilized as the output of the current consumption detection section 14 shown in FIG. 6. That is, in the embodiment shown in FIG. 6, the PWM signal is converted into a voltage value in the drive ratio control section 15 for example incorporating an integration circuit, and thus a current value supplied from the constant current circuit 11 to the monitoring element Ex is controlled.

In this case, since control is performed in such a manner that the higher the duty cycle value (pulse width) of the PWM signal, the higher the value of the direct current supplied from the constant current circuit 11 to the monitoring element Ex, control can be performed such that the progression rates of agings of the monitoring element Ex and the EL elements E1 arranged in the display panel roughly coincide with each other.

In the structure shown in FIG. 7, the output signal of the error amplifier 22, that is, the output of a terminal Out2 can be utilized as the output of the current consumption detection section 14 shown in FIG. 6. In this case, the drive ratio control section 15 shown in FIG. 6 is constituted for example by a buffer amplifier, and the value of the current supplied from the constant current circuit 11 to the monitoring element Ex is controlled based on the control voltage obtained from the drive ratio control section 15. In this structure also, control can be performed such that the progression rates of agings of the monitoring element Ex and the EL element E1 arranged in the display panel roughly coincide with each other.

Thus, with the structure of the combination shown in FIG. 6 and FIG. 7, the aging change fraction VL of the forward voltage Vf of the light emitting display EL elements E1 arranged in the display panel 10 can be effectively compensated, and in addition, the drive voltage applied to the respective pixels 10*a* is controlled in a state in which the temperature change fraction VT and the like of the Vf is also compensated. Accordingly, the power loss generated in the light emission drive transistor Tr2 in each pixel 10*a* can be restrained as much as possible.

In the embodiment shown in FIG. 6, the light emission drive transistor Tr2 by a TFT constituting each display pixel 10*a* may be operated in a saturation region or may be operated in a linear region, and in any case, operations and effects similar to those of the first embodiment described with reference to FIG. 3 can be obtained.

Further, in a case where the embodiment shown in FIG. 6 is to be utilized for a drive device of a full color display panel, it is desired to adopt a structure in which a combination of the monitoring element Ex, the constant current circuit 11, the Vf detection section 12, the power supply circuit 13, the current consumption detection section 14, and the drive ratio control section 15 is respectively provided corresponding to respective sub-pixels of R, G, and B.

Further, although the structure shown in FIG. 7 is exemplified by the case where the PWM method is adopted, a pulse frequency modulation (PFM) method or a pulse step modulation (PSM) method may also be adopted.

In this case, it is desired that the frequency of the output of the terminal Out1 is converted into a voltage in the drive ratio control section 15 shown in FIG. 6 to control the current value supplied from the constant current circuit 11 to the monitoring element Ex. Further, even in the case where the PFM or PSM drive method is adopted, the output of the terminal Out2 shown in FIG. 5 can be utilized similarly to the example already described.

The combination structure of the constant current circuit 11, the transistor Tr3, and the monitoring element Ex shown in FIGS. 3-5 can be adopted instead of the structure of the constant current circuit 11 and the monitoring element Ex shown in FIG. 6, and conversely, the combination structure of the constant current circuit 11 and the monitoring element Ex shown in FIG. 6 can also be adopted instead of the structure of the constant current circuit 11, the transistor Tr3, and the monitoring element Ex shown in FIG. 3.

Further, although the embodiments shown in FIGS. 3 and 6 described above are described based on the case where structures of the conductance control method are adopted as the light emission display pixels 10*a*, the present invention not only can be adopted in a panel of such a specific pixel structure but also can be adopted similarly in a light emitting display panel employing a pixel structure for example of a voltage write method, a current write method, a drive method of 3 TFT technique realizing digital gradation, that is, SES (simultaneous erasing scan) method, and further a threshold voltage correction method, a current mirror method, and the like.

Moreover, although all the embodiments described above are exemplified by a light emitting display panel of the active drive method, the present invention may be applied to a light emitting display panel of the passive matrix drive method.

What is claimed is:

1. A drive device of a light emitting display panel in which a large number of self light emitting elements are arranged as display pixels in a matrix pattern, characterized by comprising a monitoring element which can extract a voltage value which corresponds to the forward voltage of the self light emitting elements arranged in the light emitting display panel, a power supply section in which a power supply voltage which is given to the light emitting display panel is controlled based on the voltage value which corresponds to the forward voltage obtained from the monitoring element, a current consumption detection section which detects a current consumption value in the display panel which is driven by the power supply voltage provided from the power supply section, and a drive ratio control section which regulates a progression rate of aging in the monitoring element by controlling current which is applied to the monitoring element in response to the current consumption value detected by the current consumption detection section.

2. The drive device of the light emitting display panel according to claim 1, wherein the drive ratio control section executes a switching operation of an active element in response to the current consumption value detected by the current consumption detection section, and a time supply ratio of current supplied from a current source to the monitoring element is controlled by the switching operation of the active element.

3. The drive device of the light emitting display panel according to claim 2, wherein a combination of the monitoring element, the power supply section, the current consumption detection section, the drive ratio control section, the active element, and the current source is respectively independently provided corresponding to an emission color of the self light emitting element contained in the light emitting display panel.

4. The drive device of the light emitting display panel according to claim 1, wherein the drive ratio control section controls the value of current supplied from a current source to the monitoring element in response to the current consumption value detected by the current consumption detection section.

5. The drive device of the light emitting display panel according to claim 4, wherein a combination of the monitoring element, the power supply section, the current consumption detection section, the drive ratio control section, and the current source is respectively independently provided corresponding to an emission color of the self light emitting element contained in the light emitting display panel.

6. The drive device of the light emitting display panel according to claim 1, wherein the current consumption detection section is inserted in series to an anode side or a cathode side of the self light emitting element arranged in the light emitting display panel.

7. The drive device of the light emitting display panel according to claim 1, wherein the power supply section is constituted by a DC/DC converter of a PWM drive method, and the current consumption value detected by the current consumption detection section can be obtained in response to a duty value of a pulse signal applied to a switching element in the DC/DC converter.

8. The drive device of the light emitting display panel according to claim 1, wherein the power supply section is constituted by a DC/DC converter of a PFM drive method or a PSM drive method, and the current consumption value detected by the current consumption detection section can be obtained in response to a frequency of a pulse signal applied to a switching element in the DC/DC converter.

9. The drive device of the light emitting display panel according to claim 1, wherein the monitoring element is constituted by a self light emitting element having the same specifications as those of the self light emitting elements arranged in the light emitting display panel.

10. The drive device of the light emitting display panel according to claim 1, wherein the self light emitting element is an organic EL element which includes at least one layer of light emission functional layer made of an organic material.

* * * * *